US007080845B2

(12) United States Patent
Inchley

(10) Patent No.: US 7,080,845 B2
(45) Date of Patent: Jul. 25, 2006

(54) TRUCKS FOR SKATEBOARDS

(76) Inventor: Graham Anthony Inchley, 7, Marls Road, Borley, Southampton (GB)

( * ) Notice: Subject to any disclaimer, the term of this patent is extended or adjusted under 35 U.S.C. 154(b) by 0 days.

(21) Appl. No.: 10/767,639

(22) Filed: Jan. 29, 2004

(65) Prior Publication Data

US 2004/0245738 A1 Dec. 9, 2004

(30) Foreign Application Priority Data

Jan. 30, 2003 (GB) ..... 0302143.3

(51) Int. Cl.
*A63C 17/02* (2006.01)

(52) U.S. Cl. ..... 280/87.042

(58) Field of Classification Search ..... 280/87.042, 280/87.041, 11.27, 11.28, 11.23, 11.25, 11.19, 280/87.021, 87.03, 87.05, 809, 811, 816, 280/842

See application file for complete search history.

(56) References Cited

U.S. PATENT DOCUMENTS

| | | | | |
|---|---|---|---|---|
| 4,047,725 | A | 9/1977 | Pinchock | |
| 4,060,253 | A * | 11/1977 | Oldendorf | 280/87.042 |
| 4,109,925 | A * | 8/1978 | Williams et al. | 280/11.28 |
| 4,180,278 | A * | 12/1979 | Gottlieb | 280/87.042 |
| 5,853,182 | A * | 12/1998 | Finkle | 280/87.042 |
| 6,367,819 | B1 * | 4/2002 | Andersen et al. | 280/11.28 |
| 6,428,023 | B1 * | 8/2002 | Reyes et al. | 280/87.042 |
| 6,443,471 | B1 * | 9/2002 | Mullen | 280/87.042 |
| 6,467,782 | B1 * | 10/2002 | Smith | 280/87.042 |
| 6,474,666 | B1 * | 11/2002 | Andersen et al. | 280/87.041 |
| 6,527,284 | B1 * | 3/2003 | Bert | 280/87.041 |
| 6,547,262 | B1 * | 4/2003 | Yamada et al. | 280/11.28 |
| 2001/0038187 | A1 * | 11/2001 | Reyes et al. | 280/87.042 |
| 2002/0084602 | A1 | 7/2002 | Feng | |
| 2005/0051984 | A1 * | 3/2005 | Williams | 280/87.042 |

FOREIGN PATENT DOCUMENTS

| | | |
|---|---|---|
| EP | 0.355897 | 2/1990 |
| GB | 2242135 | 9/1991 |

* cited by examiner

*Primary Examiner*—J. Allen Shriver
(74) *Attorney, Agent, or Firm*—Gauthier & Connors LLP

(57) ABSTRACT

With reference to FIG. 1, a truck 1 for a skateboard 2 comprises a base structure 3 detachably secured to the underside 30 of the skateboard deck 4, a yoke assembly 17 having spaced-apart upper and lower portions 17*a*, 17*b* flexibly located by the base structure 3, a king-pin assembly 5 including a king-pin 7 for clamping the base structure 3 and the yoke assembly 17 together, and a pair of skateboard wheels 6 carried by the truck 1.

The arrangement is such that the rotational axis 8 of the wheels 6 is disposed substantially at right angles to the longitudinal axis 9 of the king-pin 7 and said axis 8 is also disposed at a steering head angle of substantially 30° to the vertical, (represented by vertical line 10), when the skateboard is at rest on the ground, i.e. in the position shown. The steering head axis is represented by line 31.

The king-pin axis 9 extends between the flexibly-located upper and lower portions 17*a*, 17*b*.

The rotational axis 8 of the wheels 6 remains spaced from, and substantially parallel to, the plane containing the radial arc 101 (FIG. 14) of the axis 8 as it rotates about the steering head angle α, said plane being substantially perpendicular to the steering head angle.

12 Claims, 6 Drawing Sheets

TRUCKS FOR SKATEBOARDS

FIELD OF THE INVENTION

This invention relates primarily, but not exclusively, to trucks for skateboards, although as used herein, the term "truck" relates to steering devices for means of transport other than skateboards. For example, roller-skates, or other devices that use a two-bogey, four-wheel, "lean to steer" method of changing direction.

ADVANTAGES OVER THE PRIOR ART

The invention provides a truck for a skateboard which enables a substantial degree of positive steering and requires less material to manufacture than a conventional truck so as to enable a skateboarder to improve his performance.

SUMMARY OF THE INVENTION

According to the invention, a truck for a skateboard comprises a base structure for attachment to the skateboard deck, a yoke assembly having spaced-apart portions flexibly located by the base structure, and a king-pin assembly including a king-pin for clamping the base structure and the yoke assembly together, so that with a pair of skateboard wheels carried by the truck, the arrangement is such that the rotational axis of the wheels is disposed substantially at right angles to the longitudinal axis of the king-pin and said rotational axis of the wheels is also disposed at a steering head angle of between 45° and 20° to the vertical when the skateboard is at rest, on the ground, and remains spaced from, and substantially parallel to the plane containing the radical arc of the wheel axis as it rotates about the steering head angle, said plane being substantially perpendicular to the steering head angle.

The steering head angle is preferably at substantially 30° to the vertical.

The king-pin assembly is preferably disposed between the spaced-apart portions flexibly located by the base structure.

BRIEF DESCRIPTION OF THE DRAWINGS

An embodiment of the invention will now be described by way of example only, with reference to the accompanying drawings, wherein.

DETAILED DESCRIPTION OF THE PREFERRED EMBODIMENT

Figure 1:
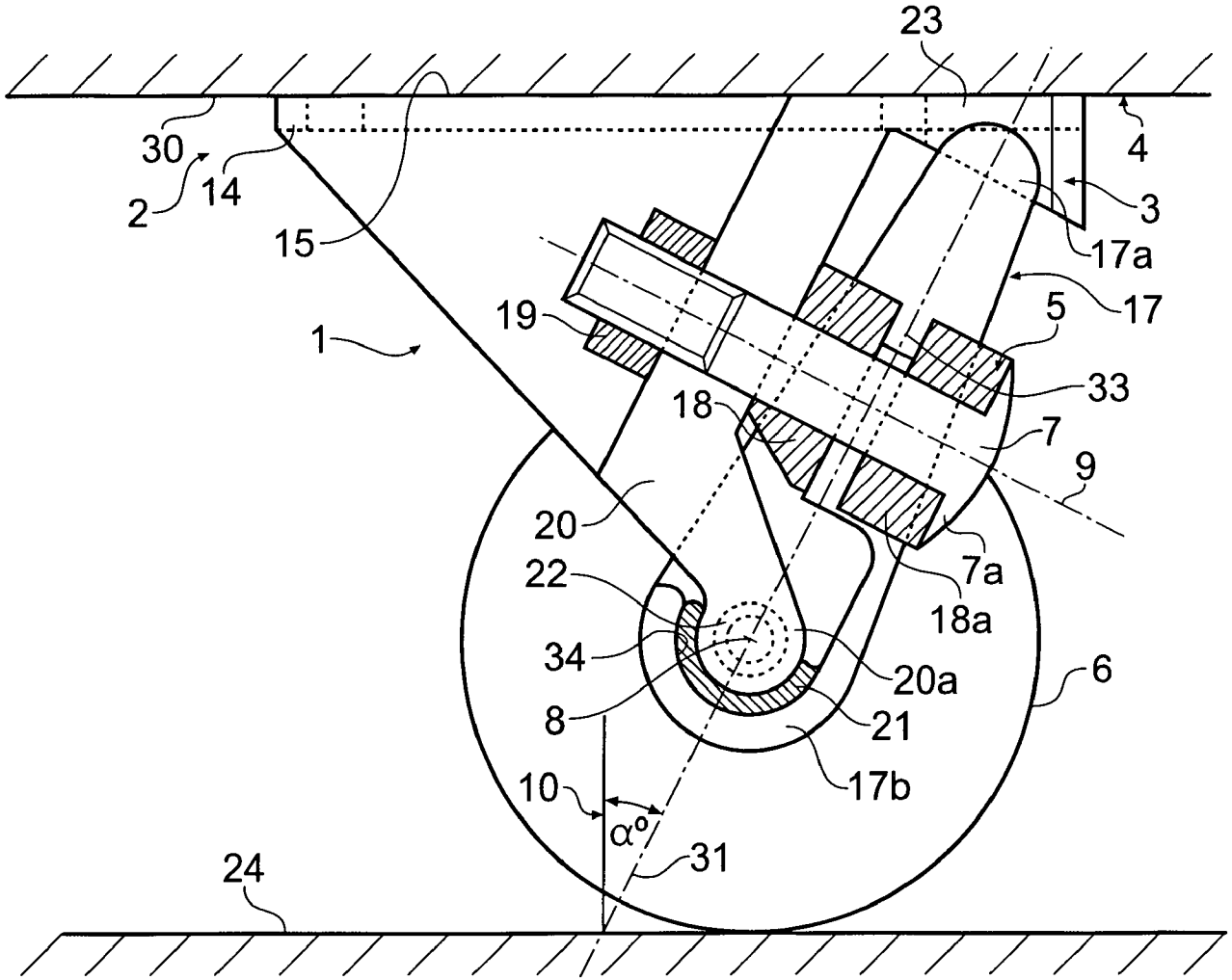
FIG. 1 is a side view in medial section of a truck for a skateboard.
Figure 3:
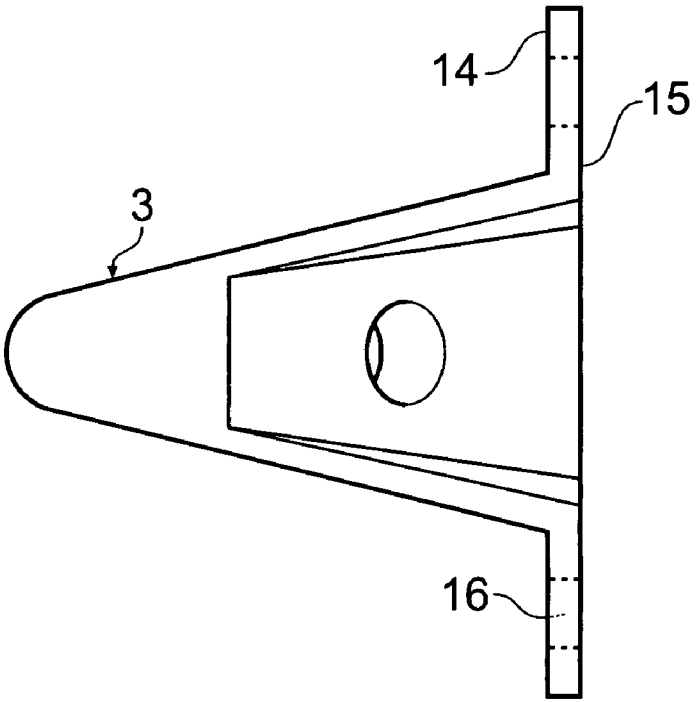
FIG. 3 is an end view in the direction of arrow A of FIG. 2.

With particular reference to FIG. 1, a truck 1 for a skateboard 2 comprises a base structure 3 detachably secured to the underside 30 of the skateboard deck 4, a yoke assembly 17 having spaced-apart (upper and lower) portions 17*a*, 17*b* flexibly located by the base structure 3, and a king-pin assembly 5 including a king-pin 7 for clamping the base structure 3 and the yoke assembly 17 together.

The arrangement is such that with a pair of skateboard wheels 6 carried by the truck 1, the rotational axis 8 of the wheels 6 is disposed substantially at right angles to the longitudinal axis 9 of the king-pin 7 and said axis rotational 8 is also disposed at a steering head angle $\alpha$ of substantially 30° to the vertical, (represented by vertical line 10), when the skateboard is at rest on the ground, i.e. in the position shown. The steering head axis is represented by line 31.

The longitudinal axis 9 of the king-pin 7 extends between the flexibly-located upper and lower portions 17*a*, 17*b*. This placement of the king-pin 7 assists control of the skateboard 2.

Figure 2:
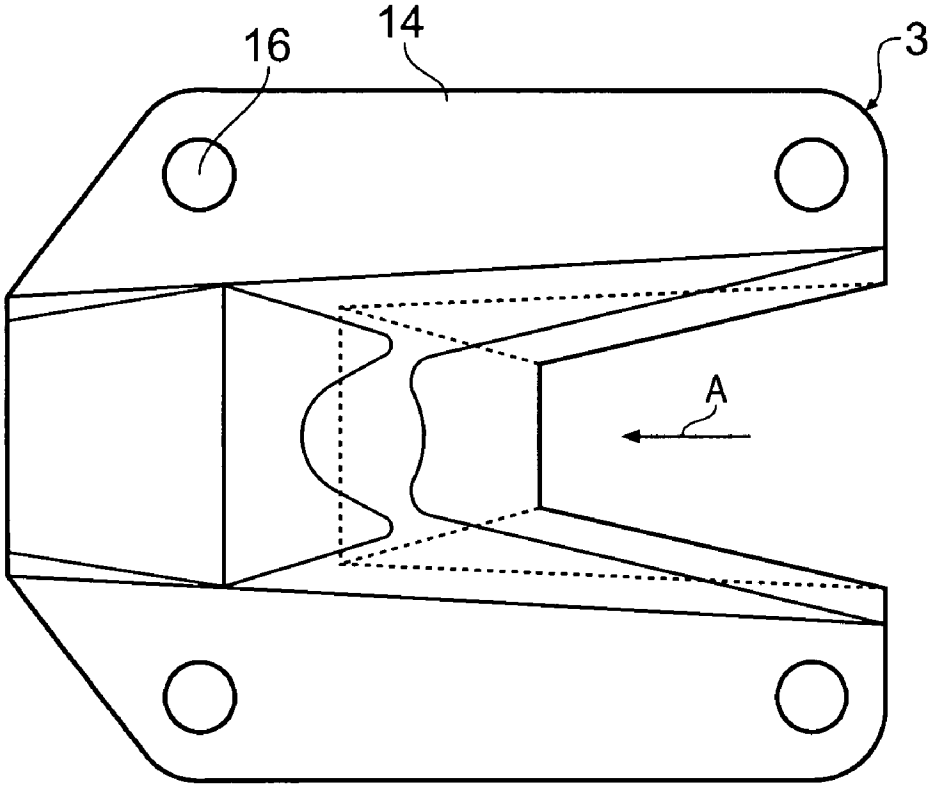
FIG. 2 is an inverted view of the base structure thereof.

The base structure 3 has a flanged portion 14 defining a flat surface 15. The portion 14 is releasably clamped to the underside of the skateboard deck 4 by four nut and bolt assemblies, (not shown), located by drilled holes 16 (FIG. 2).

Ground level is indicated by reference numeral 24.

The yoke assembly 17 carries the king-pin assembly 5, the king-pin 7 of which is located by axially-spaced bushes 18, 18*a* of resilient plastics material, such as polyurethane. The bushes 18, 18*a* are separated by an inwardly disposed flange portion 33 of the yoke assembly 17. The king-pin 7 has a button shaped head 7*a* and is releasably secured in place by a locknut 19. The base structure 20 has a lower, spherical end 20*a* which is received by a cooperating, concave, bearing 21 of resilient polyurethane located by a concave hollow 34 formed in the lower yoke portion 17*b*.

Figure 4:
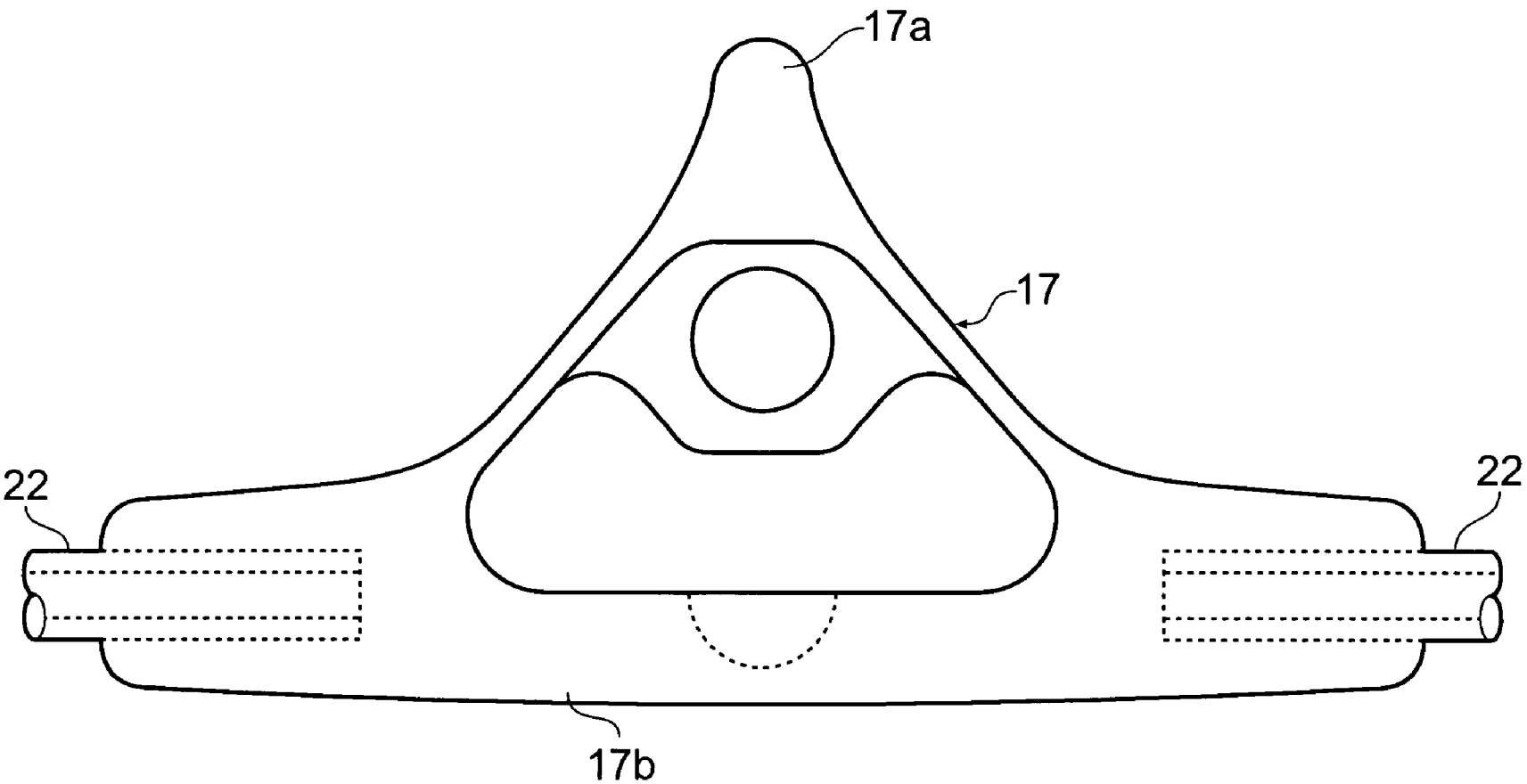
FIG. 4 is an end view of the yoke assembly.

The axis 8 of the wheels 6 is defined by a pair of hollow stub axles 22 (FIG. 4) upon which the wheels are mounted. The stub axles 22, which are steel, are located by the lower convex end 17*b* of the yoke portion 17, and are disposed well below the king-pin assembly 5. The arrangement reduces weight.

The upper end 17*a* of the yoke portion 17 is of part spherical form and is located by a cooperating bearing 23 of resilient polyurethane. The bearing 23 comprises a plug secured in the base structure 3.

The skateboard 2 is conveniently provided with two trucks 1 mounted on the skateboard deck 4 in tandem. Each truck is a mirror image of the other. As the skateboard deck 4 is tilted towards the intended change in direction, the yoke assemblies 17 rotate about their steering head axis 31. Tilting the skateboard deck 4 to the left for example, causes the front and rear outer wheels 6 to move apart, and the front and rear inner wheels 6 to move together, resulting in the intended change of direction.

When pressure is released from the skateboard deck 4, the yoke portions 17 are returned to their central positions by resilience in the bushes 18, and 18*a*. The steering head angle of each truck 1 remains substantially constant during manoeuvres.

The material of both the base structure 3 and yoke assembly 17 of each truck 1 is preferably of T6 spec aluminium alloy or titanium. The king-pin 7, which preferably is of high tensile steel, acts as a locking device to prevent the yoke portion 17 separating from the base structure 20. The yoke portion 17 is disposed between the bushes 18, 18*a* so that a substantially uniform compression force, (adjustable, depending on the skateboard rider's weight), is imparted. This compressive force keeps the yoke portion 17 in a substantially central position. The bushes 18, 18*a* also assist in locking (clamping) the yoke portion 17 to the base structure 20 bearings.

The bushes 18, 18*a* can be changed to suit requirements. For example, salom, downhill speed racing or bowl riding.

The yoke portion 17 supports the associated wheel stub axles 22 which in turn supports the wheels 6 and their bearings. As steering inputs are made, the yoke portion 17 pivots about the base plate 20 and a change in direction occurs. The width of the yoke portion 17 can be changed to suit requirements.

To reduce weight, up to an inner one third of stub axle material could be removed.

The upper and lower bearings 23, 21 serve as shock absorbers and ensure a good fit between the yoke portion 17 and base structure 20.

Figure 12:
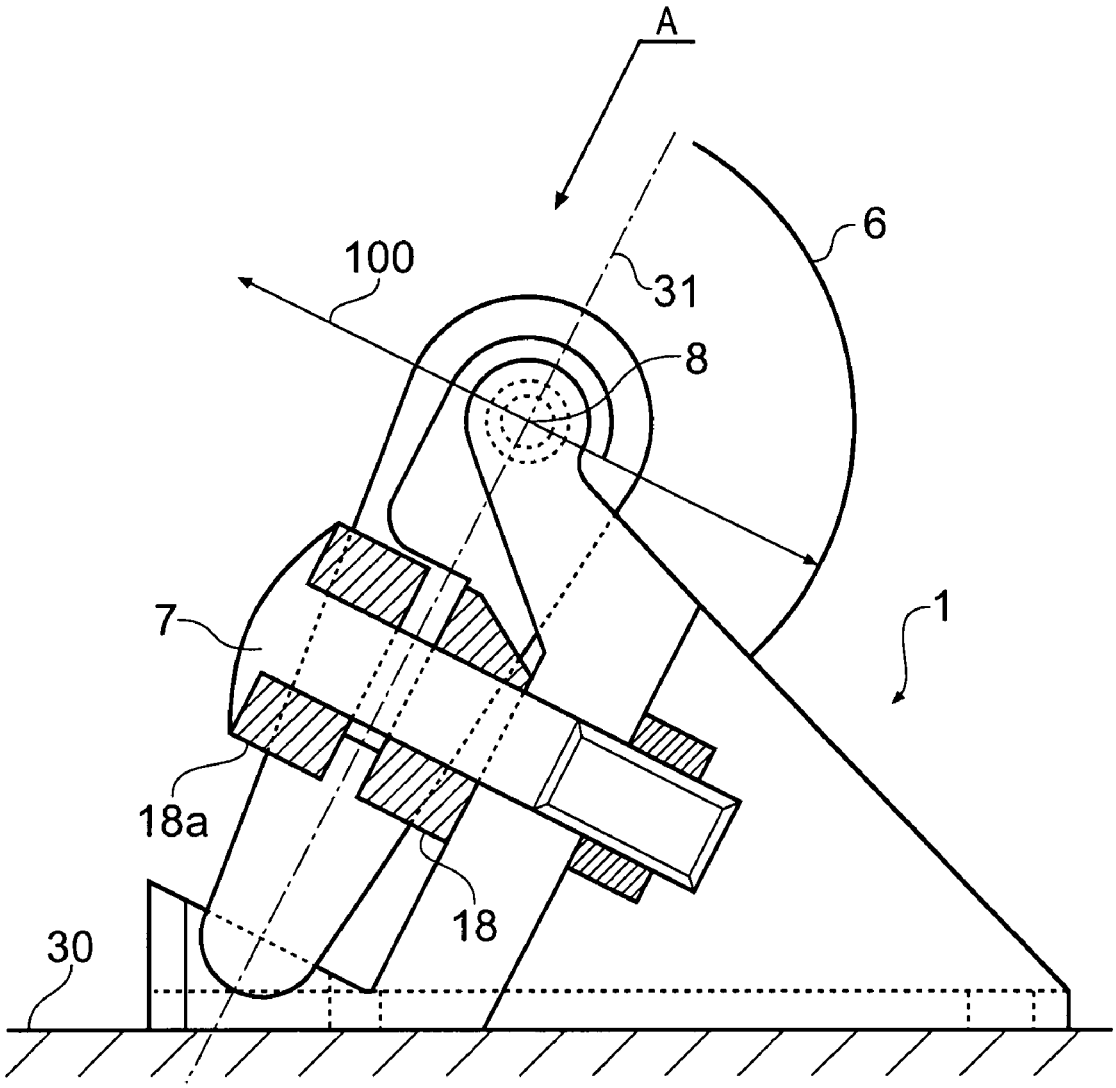
FIGS. 12 to 14 illustrate further details of the various axes etc.
Figure 13:
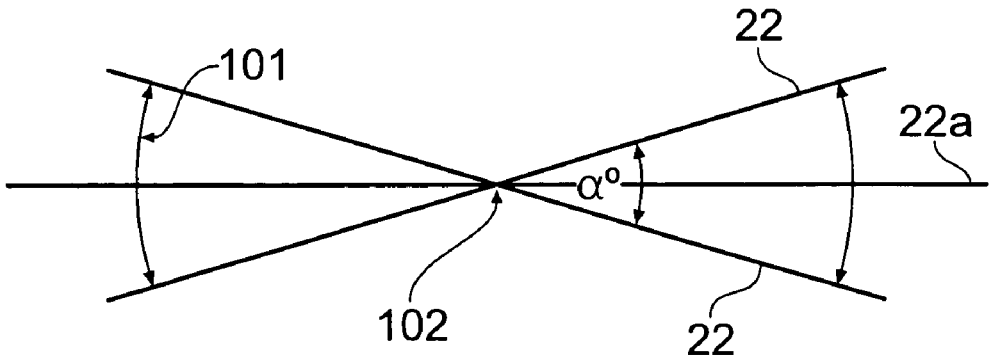
Figure 14:
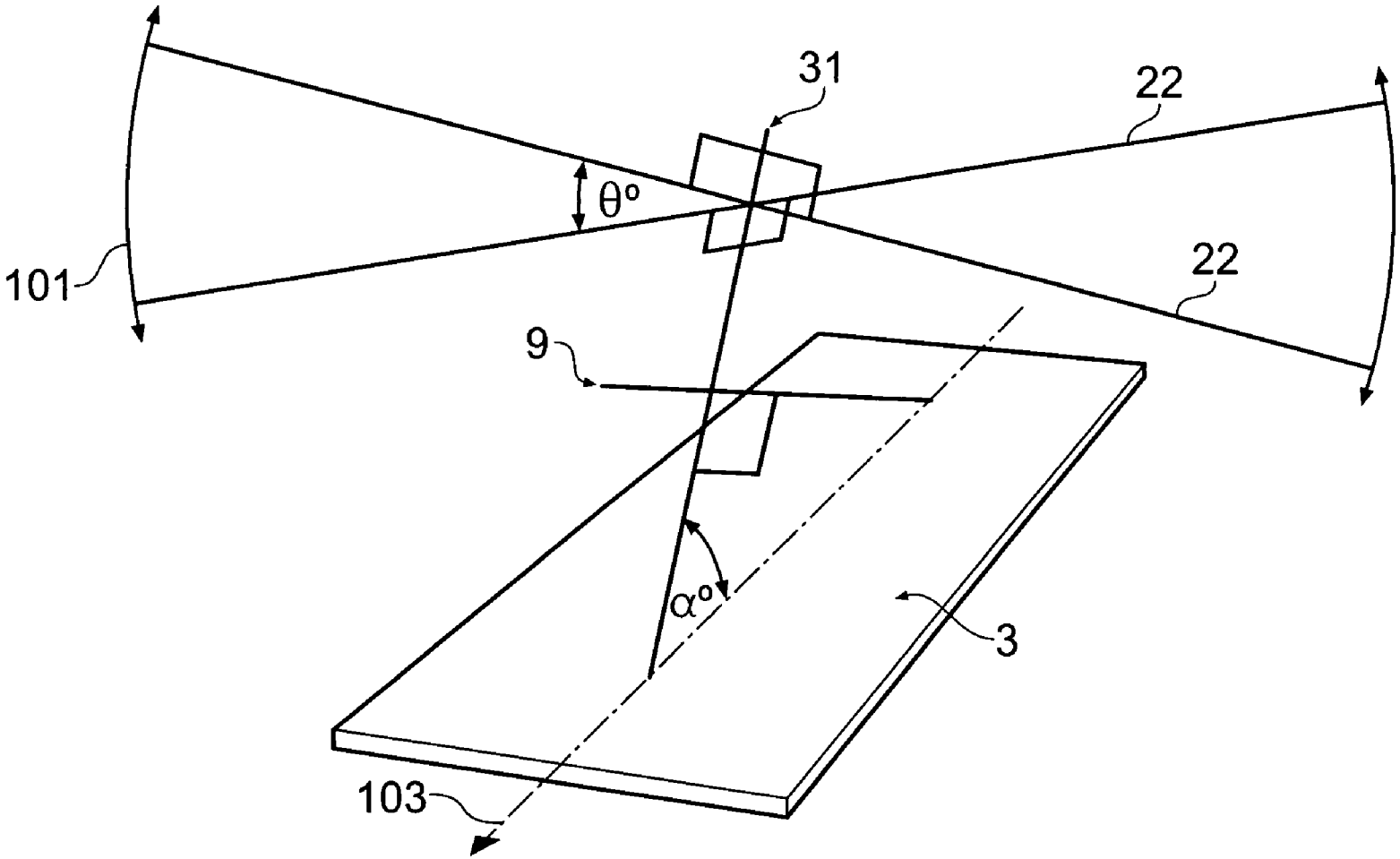

FIGS. 12 to 14 illustrate further details of the truck 1. FIG. 12 is similar to FIG. 1 but turned through 180°, and shows the steering head axis 31 and the radial motion 100 of the rotational axis 8 of the wheels 6.

FIG. 13 is a diagrammatic view, looking in the direction of arrow "A" of FIG. 12, and shows the radial arc 101 scribed by the rotational axis 8 of the wheels 6. The static position of the axles 22 is shown at 22*a*. Angle $\alpha$ is the total radical displacement of the wheel axles 22.

The angle of steer is indicated by reference numeral 102.

FIG. 14 shows the base structure 3, axles 22, radial arc 101, steering head axis 31, steering head angle $\alpha$, axle radial displacement $\theta$, and king pin axis 9. Truck forward motion is indicated by arrow 103.

The rotational axis 8 of the wheels 6 remains spaced from, and substantially parallel to the plane containing the radial arc 101 of the wheel axis 8 as it rotates about the steering head angle $\alpha$, said plane being substantially perpendicular to the steering head angle $\alpha$.

Figure 6:
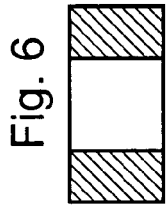
FIGS. 6, 7 and 8 and FIGS. 9, 10 and 11 illustrate details of bushes that may be employed by the yoke assembly.
Figure 7:
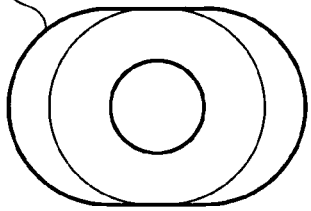
Figure 8:
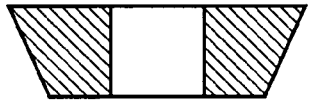
Figure 5:
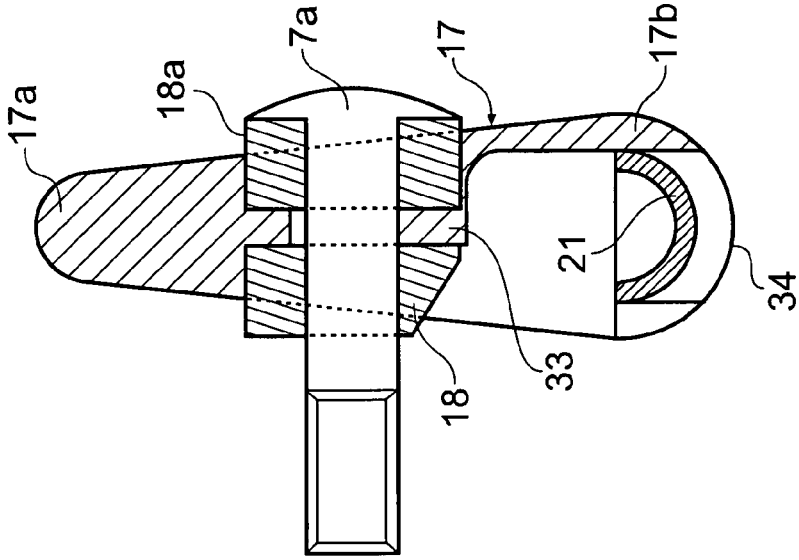
FIG. 5 is a side view of the yoke assembly.

In the modified yoke assembly illustrated by FIG. 5, the bearing 21 is held in place by a plug 34 secured in the lower portion 17*b* of the yoke assembly 17. FIGS. 6, 7 and 8 illustrate alternative upper bushes 18. The bush 18 of FIG. 8 has a frusto-conical profile.

Figure 9:
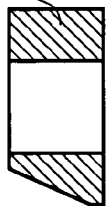
Figure 10:
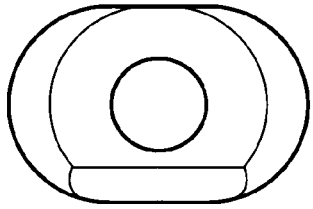
Figure 11:
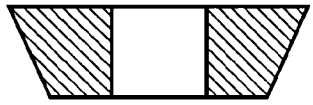

FIGS. 9, 10 and 11 similarly illustrate alternative lower bushes 18*a*. The bush 18*a* of FIG. 9 has a chamfered edge.

The shapes of the bushes 18*a* aid assembly and disassembly of a truck 1, as they then avoid interference with adjacent parts of the truck.

As mentioned above, the steering head angle $\alpha$ may be between 45° and 20° to the vertical. However, an angle of substantially 30° to the vertical is preferred.

It will be appreciated that a truck according to the invention has application other than to a truck for a skateboard. For example, roller-skates or other devices that use a two-bogey, four wheel, lean to "steer" method of changing direction.

The invention claimed is:

1. A truck for a skateboard, the skateboard having a deck comprising a base structure for attachment to the skateboard deck, a yoke assembly having a spaced-apart portions flexibly supported by the base structure by oppositely-facing upper and lower support structure in substantial alignment, and a king-pin assembly including a king-pin for clamping the base structure and the yoke assembly together, so that with a pair of skateboard wheels carried by the truck, the arrangement is such that the rotational axis of the wheels is disposed substantially at right angles to the longitudinal axis of the king-pin and said rotational axis of the wheels is also disposed at a steering head angle of between 45° and 20° to the vertical when the skateboard is at rest on the ground, and remains spaced from, and substantially parallel to the plane containing the radial arc of the wheel axis as it rotates about the steering head angle, said plane being substantially perpendicular to the steering head angle.

2. A truck as claimed in claim 1, wherein the steering head angle is substantially 30° to the vertical.

3. A truck as claimed in claim 1, wherein the longitudinal axis of the king-pin extends between the spaced apart portions flexibly located by the base structure.

4. A truck as claimed in claim 1, wherein the king-pin is located by a pair of axially-spaced bushes of resilient material carried by the yoke assembly, and wherein said bushes are separated by an inwardly disposed flange portion of the yoke assembly.

5. A truck as claimed in claim 4, wherein one of the said bushes is of frusto-conical form.

6. A truck as claimed in claim 4, wherein one of the said bushes has a chamfered edge.

7. A truck as claimed in claim 4, wherein resilient material of said bushes is polyurethane.

8. A truck as claimed in claim 1, wherein one spaced-apart portion of the yoke assembly is of part-spherical form.

9. A truck as claimed in claim 1, wherein one spaced-apart portion of the part-spherical portion of the yoke assembly is located by a co-operating bearing of resilient material.

10. A truck as claimed in claim 1, wherein one spaced-apart portion of the yoke assembly is formed with a concave hollow which locates a bearing of resilient material which receives a spherical part of the base structure.

11. A truck as claimed in claim 1, wherein the yoke assembly has an upper end and a lower end, the upper end being of part-spherical form, said upper support structure defining a cooperating bearing surface.

12. A truck as claimed in claim 1, wherein the yoke assembly has an upper end and a lower end, the lower end being of convex form, said lower support structure defining a cooperating bearing surface of concave form incorporated in the said lower support structure.

* * * * *